US005768992A

United States Patent [19]

Daw et al.

[11] Patent Number: 5,768,992

[45] Date of Patent: Jun. 23, 1998

[54] HAND STAMP AND METHOD OF ASSEMBLING SAME

[75] Inventors: Sean P. Daw, Brooklyn; John R. Laverack, Beacon, both of N.Y.

[73] Assignee: M&R Marking Systems, Inc., Piscataway, N.J.

[21] Appl. No.: 653,408

[22] Filed: May 24, 1996

[51] Int. Cl.[6] ..... B41K 1/42

[52] U.S. Cl. ..... 101/334; 101/104

[58] Field of Search ..... 101/104, 105, 101/327, 333, 334

[56] References Cited

U.S. PATENT DOCUMENTS 2,038,338 4/1936 Baumgarten .
2,079,080 5/1937 Melind .
3,216,352 11/1965 Schnackel .
4,432,281 2/1984 Wall et al. .
4,841,860 6/1989 Fehling ..... 101/334
4,852,489 8/1989 Wall et al. .
4,970,954 11/1990 Weir et al. ..... 101/334
5,152,223 10/1992 Mairon .
5,359,932 11/1994 Van Breene ..... 101/334

*Primary Examiner*—Ren Yan
*Attorney, Agent, or Firm*—Lerner, David, Littenberg, Krumholz & Mentlik

[57] ABSTRACT

A hand stamp and a method of assembling such hand stamp is disclosed. The hand stamp includes a frame having an open top for receiving a platen during assembly operations.

22 Claims, 10 Drawing Sheets

HAND STAMP AND METHOD OF ASSEMBLING SAME

FIELD THE INVENTION

The present invention pertains to hand stamps. More particularly, the present invention pertains to self-inking and pre-inked hand stamps and an efficient method of assembling such hand stamps.

BACKGROUND OF THE INVENTION

Many brands of self-inking stamps and pre-inked stamps are available in the commercial market. One brand of high quality self-inking stamps is sold by M&R Marking Systems, Inc. of Piscataway, New Jersey under the trademark IDEAL. M&R Marking Systems also sells high quality pre-inked hand stamps under the trademark ROYAL MARK.

It should be appreciated that although the present invention is particularly useful as a self-inking stamp and a method of assembling such a self-inking stamp, it may also be used as a pre-inked stamp and a method of assembling the same. Accordingly, both of these types of stamps will be collectively referred to herein as hand stamps.

Great efforts have been expended to develop hand stamps which can be quickly and inexpensively assembled while maintaining desirable high quality features. For example, IDEAL brand hand stamps are assembled on state of the art high speed production machinery. These high quality stamps can therefore be offered at competitive prices.

U.S. Pat. No. 5,152,223 discloses a hand stamp having a frame, a platen and a case wherein the frame includes a slot which is entirely open at a bottom portion of the frame. The '223 patent discloses that the structure of the hand stamp described therein can be quickly and inexpensively assembled. There is no disclosure, teaching or suggestion to arrange a slot within the frame of the stamp disclosed in the '223 patent wherein the slot is open at the top portion of the frame.

It is also known in the art to provide a frame for self-inking stamps wherein the frame includes a slot which is closed at both the bottom and top portions thereof. A platen is placed between the slots by first arranging one side of the platen within one of the opposing sides and then arranging the other side of the platen within the other opposing slot. A relatively lengthy assembly procedure is required to obtain this arrangement.

Another prior art self-inking stamp is manufactured by Trodat as model no. 4923. This stamp includes first and second interlocking frame members. One of the frame members includes a pair of opposing slots which are open at a top portion and are closed at the bottom portion. A platen including an axle may be arranged within the opposing slots of the first frame member. The second frame member is then interlocked with the first frame member to form a completed frame member. The slot of the completed frame member is closed at both the bottom and top portions thereof. A case is then arranged over the completed frame member and is coupled to the axle of the associated platen. This prior art self-inking stamp has various shortcomings. First, it requires additional tooling and expenses associated with the manufacture of the two-part frame member. Second, this self-inking stamp requires a relatively complicated and lengthy assembly procedure due to the step of interconnecting the first and second frame members together to form a completed frame member.

The present invention overcomes the shortcomings of the prior art by providing a hand stamp and a method of assembling the hand stamp in a particularly efficient manner.

SUMMARY AND OBJECT OF THE INVENTION

In accordance with one aspect of the present invention, a hand stamp is provided. The hand stamp may be a self-inking stamp or a pre-inked stamp.

The hand stamp preferably includes a platen adapted for movement between a stamping position and a non-stamping position. When the hand stamp is intended to be used as a self-inking stamp, the platen may be operatively arranged for movement between a stamping position and an inking position. The platen is arranged in a stamping position when a stamping member carried by the platen is arranged against a surface where an impression or an ink design is formed. Conversely, the platen may be said to be arranged in a non-stamping position when it is remote from a surface so that no impression or ink design is being created. In a self-inking stamp embodiment, a non-stamping position may be considered the inking position where the stamping member carried by the platen is adjacent to an ink pad within the hand stamp. The hand stamp also includes a frame having a top portion, a bottom portion and at least a pair of opposing side portions. Optionally, the frame may include a front and a rear section. The frame also includes a passageway arranged at the top portion which extends downwardly along the opposing side portions toward the bottom portion. The passageway is open at the top portion of the frame for receiving the platen during assembly operations. In a particularly preferred embodiment, the passageway comprises first and second opposing slots arranged in the opposing side portions of the frame. Each of the opposing slots in this embodiment of the present invention is open to receive the platen at the top portion of the frame.

In a preferred embodiment of the present invention, the hand stamp includes a one-piece frame. This aspect of the present invention reduces the cost of tooling and materials over prior art hand stamps which often require a multi-piece frame. Further, the unitary frame aspect of the present invention also provides an advantage over hand stamps which use multi-piece frames in that assembly operations are facilitated.

In a further preferred embodiment of the present invention, the hand stamp frame includes first and second opposing slots which have an open passageway at the top portion of the frame when the hand stamp is fully assembled. In accordance with this preferred embodiment, the hand stamp preferably includes a unitary frame. However, the slots remain open when the hand stamp is assembled regardless of the quantity of frame components.

In another preferred embodiment, the first and second opposing slots are closed at the bottom portion of the frame. However, it should be appreciated that the slots may also be open at the bottom portion of the frame.

The hand stamp may also comprise a case connected to the platen which is mounted over a portion of the frame. The case may be used as an actuating member for moving the platen between the non-stamping position and the stamping position upon sliding of the platen along the slots within the pair of opposing side portions of the frame.

The platen may comprise a central body having a first side and a second side and first and second projections which extend from the corresponding first and second sides. When the hand stamp is in assembled position, the first and second projections may be arranged within corresponding first and second opposing slots. It is preferable for the case of the hand stamp to be connected to the first and second projections of the platen.

The central body of the platen preferably includes a stamp-carrying surface. As this term implies, a stamping structure may be mounted on the stamp-carrying surface. The stamping structure may be used to repetitively create stamped terms or designs on an intended surface. The platen and the frame of the present hand stamp may include cooperating turnover means for facilitating movement of the stamp-carrying surface of the platen between a non-stamping position (which may or may not be on inking position) and a stamping position.

The turnover means on the frame may comprise at least one fixed cam arranged on at least one of the first and second sides thereof. The turnover means on the platen may comprise at least one cam follower arranged to cooperate with the at least one fixed cam of the frame so that the platen can be flipped between its non-stamping and its stamping position. Preferably, the frame includes a fixed cam arranged on each of the first and second sides thereof. Similarly, it is preferable for the platen to include a pair of cam followers arranged on opposing sides to operatively cooperate with the fixed cams of the frame.

In accordance with another aspect of the present invention, a method of assembling a hand stamp is provided. The method comprises the steps of providing a frame which has a top portion and a bottom portion. The frame also includes a passageway which is open at the top portion and which extends downwardly toward the bottom portion thereof. The method also comprises the step of arranging a platen within the frame by placing the platen through the open passageway at the top portion of the frame.

In accordance with a preferred method, at least one spring is arranged on top of the frame after the platen has been placed within the frame passageway. A case is then arranged over the at least one spring and the top portion of the frame. The case is then preferably connected to the platen so that the platen can be moved between a non-stamping position and a stamping position during use of the hand stamp. At this time, the at least one spring is compressed between the top of the frame and the inside portion of the top of the case.

When a preferred embodiment of the present hand stamp is used with the present method, the platen will comprise a central body having first and second sides and a first projection extending from the first side and a second projection extending from the second side. In this preferred embodiment, the central body of the platen may include a stamp-carrying surface, and the platen and the frame may include cooperating turnover means for facilitating movement of the stamp-carrying surface between its non-stamping position and its stamping position. When this preferred embodiment is used, the step of arranging the platen within the frame may comprise the step of placing the first and second projections of the platen within the open passageway at the top portion of the frame and thereafter releasing the platen so that the cooperating turnover means causes the platen to flip as it falls to a rest position within the frame.

It is also preferable for the method of the present invention to include the step of arranging a case over a portion of the frame and connecting the case to the first and second projections of the platen.

The passageway of the frame may comprise first and second opposing slots arranged within first and second side walls of the frame. When this preferred embodiment is used, the step of arranging the platen within the frame may comprise placing the first and second projections within corresponding first and second opposing slots.

It is also preferable to perform the step of connecting the case to the first and second projections of the platen when the platen is arranged at the bottom portion of the frame. When a preferred embodiment of the hand stamp is used, the first and second opposing slots are closed at the bottom portion of the frame. However, in alternate embodiments, the slots may be open at both the top and bottom portions of the frame.

In accordance with still another aspect of the present invention, a novel locking structure for preventing the case from becoming separated from the frame is provided. In accordance with this aspect of the present invention, the hand stamp may comprise a frame which includes a pair of opposing side walls wherein a locking tab projection extends from at least one of the opposing side walls. The hand stamp may also comprise a platen operatively arranged within the frame for movement between a non-stamping position and a stamping position. A case is also provided and is connected to the platen. The case may include a double-walled section arranged over the opposing side walls of the frame. The double-walled section may include at least one ledge adapted to contact the at least one locking tab projection of the frame to prevent the frame from becoming separated from the case after the case is arranged in assembled position over the frame.

The preferred locking structure of the present hand stamp is a particularly efficient and inexpensive locking structure to manufacture. Preferably, the platen includes a central body having first and second sides and a first projection extending from the first side and a second projection extending from the second side. A portion of the double-walled section of the case may include first and second flexible fingers, each of which has a recess therein. The recesses are preferably sized and shaped to receive corresponding first and second projections of the platen when the case is connected to the platen in assembled position. The double-walled section of the case includes an inner wall and an outer wall. Preferably, the first and second flexible fingers comprise at least a portion of the inner wall, and the at least one ledge is part of the inner wall.

It is an object of the present invention to provide a high quality hand stamp which can be assembled in a particularly quick and efficient manner.

It is another object of the present invention to provide a high quality hand stamp which can be manufactured at a low cost.

It is still another object of the present invention to provide a hand stamp including a novel locking structure for retaining the case and the frame in assembled position.

These and other objects and features of the present invention will be better understood when read in conjunction with the accompanying drawings and the detailed description which follows.

DETAILED DESCRIPTION OF THE PREFERRED EMBODIMENTS

Figure 28:
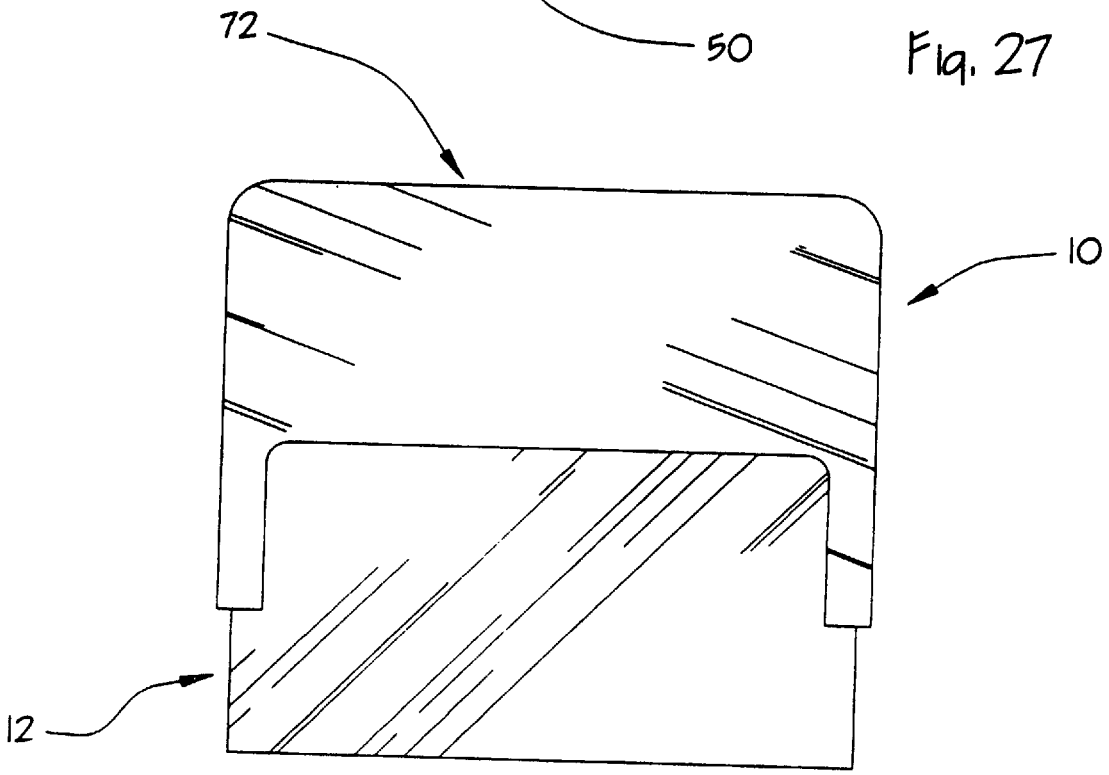
FIG. 28 is a perspective view of one embodiment of a completed hand stamp design.

Various types of hand stamp designs may be used in accordance with the present invention. One example of a completed hand stamp design is shown in FIG. 28 and is designated by reference numeral 10. It should be understood that numerous external designs can be used with the novel features of the present invention as discussed herein, and thus, hand stamp 10 of FIG. 28 is intended by way of illustration only.

The hand stamp 10 includes three main components. These components are a unitary frame 12 (see FIGS. 1–3), a platen 50 (see FIGS. 4–7) and a case 72 (see FIGS. 8–10). Springs 104 and 106 (see FIGS. 24–27) may also be provided.

Figure 1:
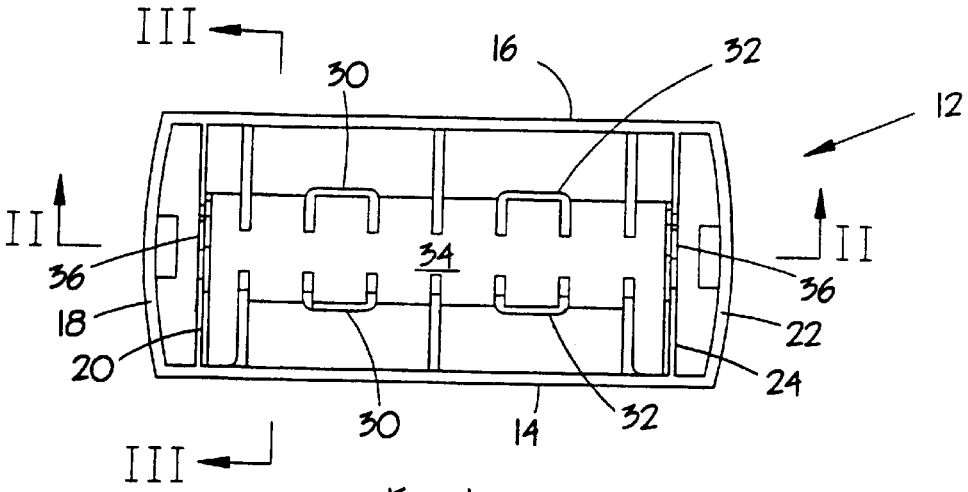
FIG. 1 is a top plan view of the frame of a hand stamp in accordance with the present invention.
Figure 2:
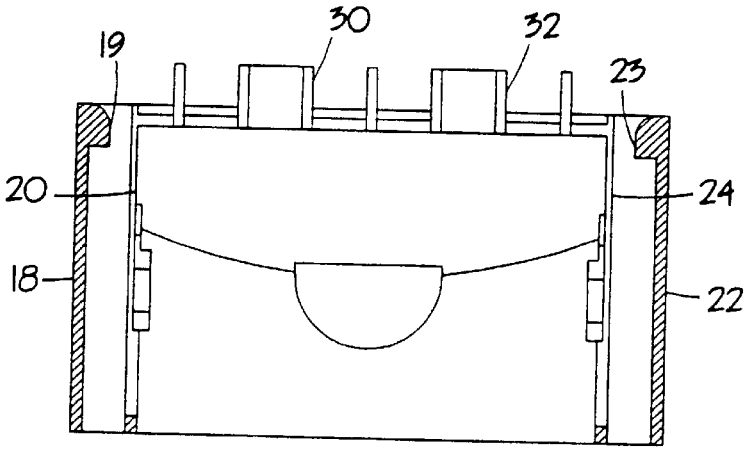
FIG. 2 is a front sectional view of the frame taken along line II—II of FIG. 1.
Figure 3:
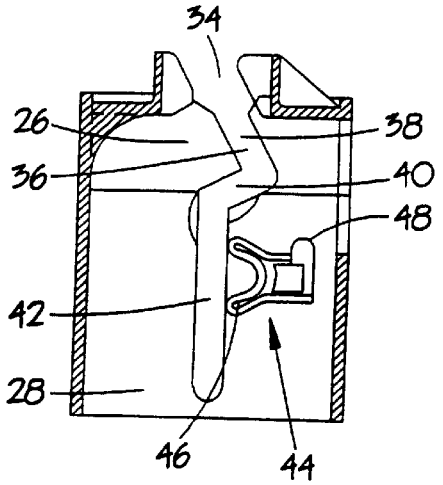
FIG. 3 is a side sectional view of the frame taken along line III—III of FIG. 1.
Figure 4:
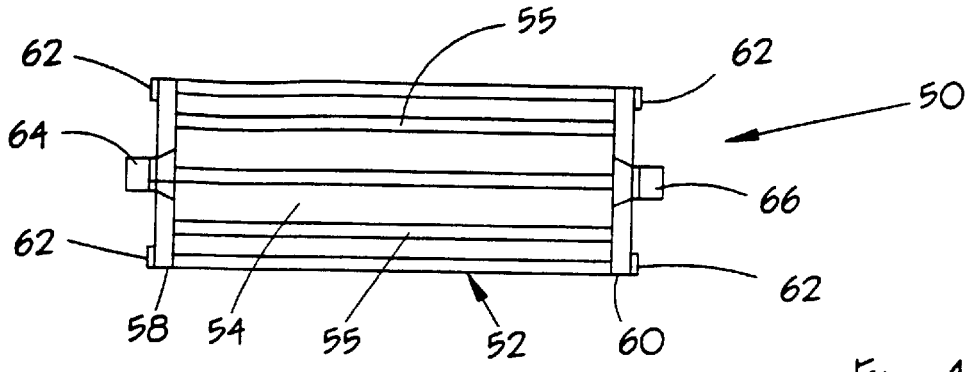
FIG. 4 is a top plan view of the platen of the hand stamp of the present invention.
Figure 5:
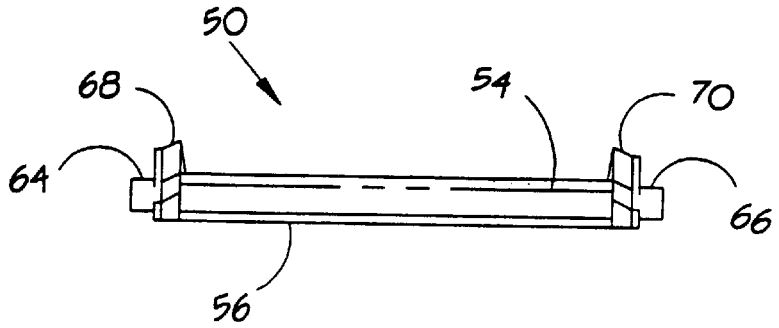
FIG. 5 is a front view of the platen shown in FIG. 4.
Figure 6:
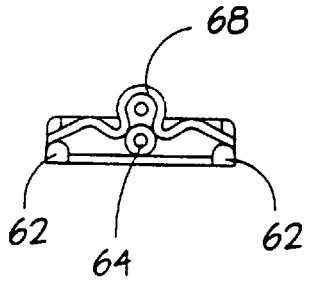
FIG. 6 is a side view of the platen shown in FIGS. 4 and 5.
Figure 7:
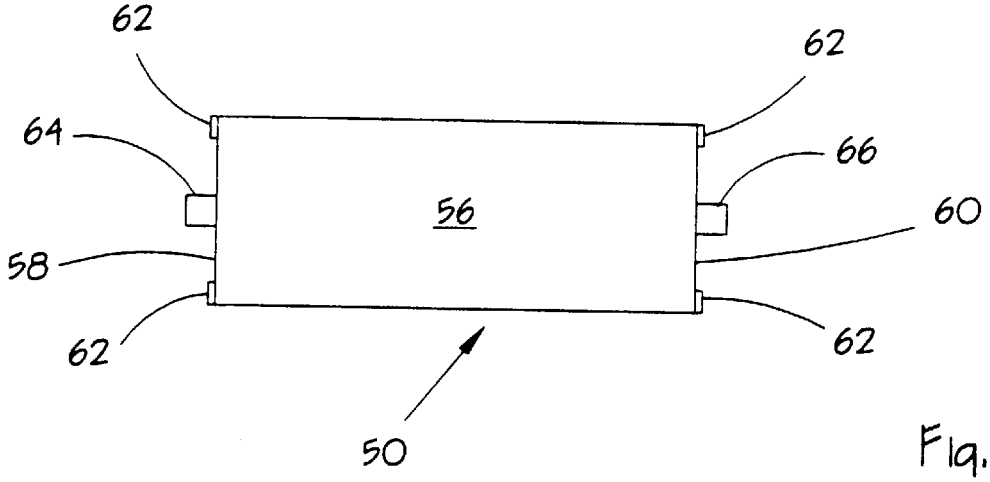
FIG. 7 is a bottom plan view of the platen shown in FIGS. 4–6.

As shown in FIGS. 1–3, the frame 12 of the hand stamp 10 may include a front wall 14 and a rear wall 16. The front and rear walls 14 and 16 are optional features which provide a preferred rigidity to the overall frame structure. As shown in the preferred embodiment of FIGS. 1–3, the frame 12 includes a pair of double-walled sections. In particular, the frame 12 includes a left side outer wall 18 and a left side inner wall 20. Similarly, a right side outer wall 22 and a right side inner wall 24 are provided.

The frame 12 also includes a top portion 26, which is considered the general area near the top of the frame, and a bottom portion 28, which is considered the general area near the bottom of the frame. Left and right locking tab projections 19 and 23 extend inwardly from the top portion 26 of respective left and right side outer walls 18 and 22 of the frame 12.

With reference to FIGS. 1 and 2, the frame 12 also includes a left side spring retainer 30 and a right side spring retainer 32. Each of the spring retainers 30 and 32 appear to be split in half as a guide slot 34 extends centrally through the body of the frame from the top portion 26 toward the bottom portion 28 thereof. The guide slot 34 extends through the left and right inner side walls 20 and 24. The portion of the guide slot 34 which extends through the left and right inner walls has been designated by reference numeral 36 for clarity in describing the present invention.

The guide slot 34 may include various portions which extend from the top portion 26 toward the bottom portion 28 within the left and right side inner walls 20 and 24. As shown in FIG. 3, the top most portion of the guide slot 36 may extend within the left side inner wall 20 of the frame 12 at an angle of approximately twenty eight degrees with respect to a vertical axis. This angle may vary in alternate embodiments. For example, in an alternate embodiment of the present invention, the guide slot 36 may extend straight down from the top portion 26 to the bottom portion 28 of the frame 12.

A second angled portion of the guide slot 36 is designated by reference numeral 40. This portion of the guide slot extends downwardly at an angle away from the first portion of the guide slot. Finally, the guide slot 36 includes a third portion 42 which extends straight down toward the bottom portion 28 of the frame 12.

As shown in FIGS. 2 and 3, the left and right side inner walls 20 and 24 may each include a turnover mechanism generally designated 44. This type of turnover mechanism is known in the art and includes a fixed cam 46 and a bumper 48 spaced from the cam 46.

As illustrated in FIGS. 4–7, the platen 50 includes a central body 52 which has a top surface 54. The top surface may include ribs 55 to provide the desired rigidity. The central body 52 may also include a stamp-carrying surface 56 which will also be referred to herein as the bottom surface of the platen. The platen 50 includes a left side 58 and a right side 60. A bumper pin 62 is located on each corner of the left and right sides 58 and 60. The bumper pins 62 are an optional feature of the present invention and may be an integral molded component of the platen 50.

The platen may include an axle having a left projection 64 and a right projection 66 which extend from their respective left and right sides 58 and 60 of the central body 52. This feature of the present invention is clearly shown in FIGS. 4–7.

The platen 50 also includes a cam follower 68 on the left side and a cam follower 70 on the right side thereof. The cam followers 68 and 70 may be integral molded portions of the platen 50. The operative relationship between the cam followers 68 and 70, the bumper pins 62 and the turnover mechanisms 44 (including the bumper 48 and the fixed cam 46) arranged on the frame 12 will be discussed hereinbelow in connection with the method of loading the platen 50 into the frame 12.

Figure 8:
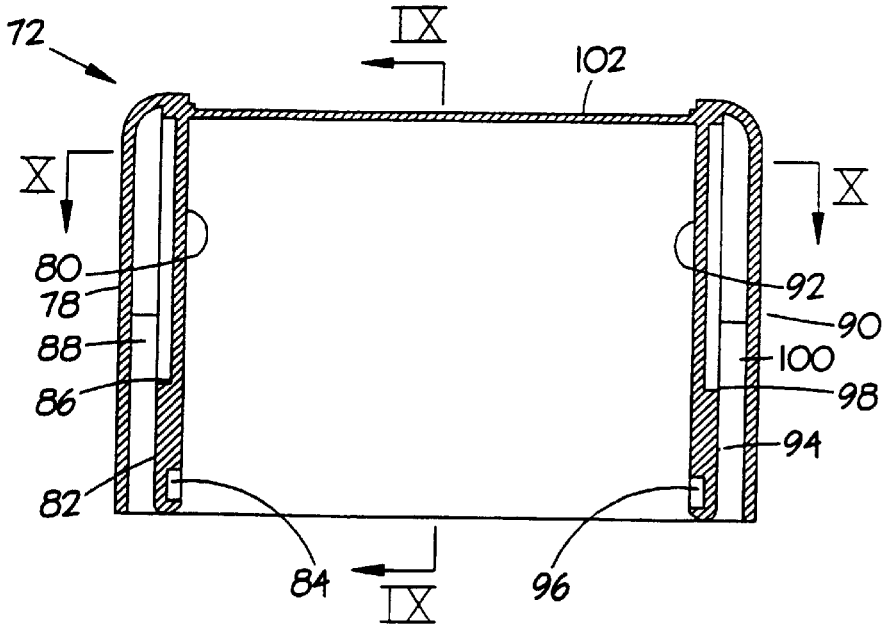
FIG. 8 is a front sectional view of the case of the hand stamp of the present invention.
Figure 9:
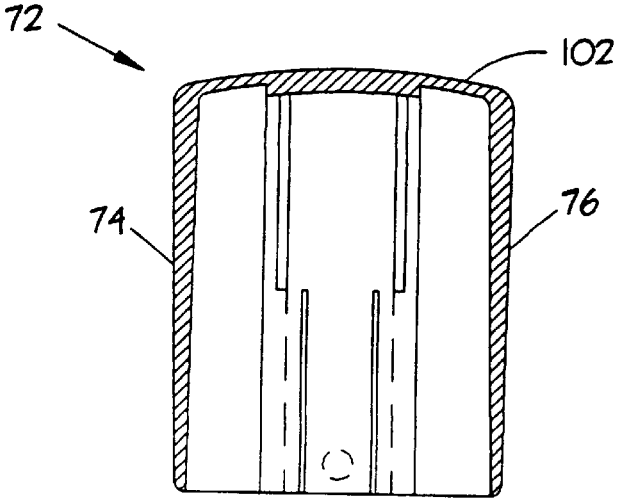
FIG. 9 is a side sectional view of the case taken along line IX—IX of FIG. 8.
Figure 10:
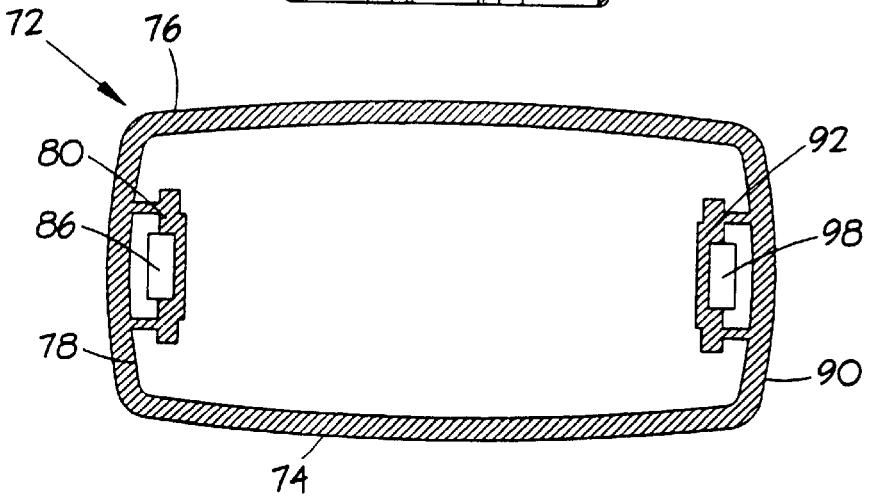
FIG. 10 is a top sectional view of the case taken along line X—X of FIG. 8.

The hand stamp of the present invention preferably comprises a case 72 as shown in FIGS. 8–10. The case 72 includes optional front and rear sides 74 and 76. As also shown in FIG. 8, the case 72 also includes a pair of double-walled sections. In particular, the case 72 includes a left outer wall 78 and a left inner wall 80. A flexible finger 82 is arranged at the bottom portion of the left inner wall 78. A recess 84 is arranged at the bottom portion of the flexible finger 82. The recess 84 is preferably sized and shaped to receive one of the projections of the platen 50 when the case 72 is arranged in assembled position over a portion of the frame 12 and when it is connected to the platen 50 as will be discussed further below.

The outer side of the flexible finger 82 defines a ledge 86, which comprises a component of the locking feature between the case 72 and the frame 12 as will also be discussed further below. As shown in FIG. 8, a space 88 exists between the left outer wall 78 and the left inner wall 80. The dimensions of this space varies above and below the ledge 86. This aspect of the present invention is also related to the locking feature between the case 72 and the frame 12.

As the case 72 is symmetrical, the right side is identical to the left side. Thus, the right side includes a double-walled section comprising a right outer wall 90 and a right inner wall 92. A flexible finger 94 is arranged at the bottom of the right wall and a recess 96 is arranged at the bottom of the right flexible finger 94 for receiving a corresponding projection of the platen. The outside of the right flexible finger also includes a ledge 98 and a space 100 is provided between the right outer wall 90 and inner wall 92.

As shown in FIGS. 8, 9 and 24–27 the case 72 also includes a top section 102 for interacting with the top of a pair of springs 104 and 106. The springs are arranged around the spring retainers 30 and 32 at the top of the frame 12 and are compressed between the top of the frame and the top of the case 102 when the hand stamp is in fully assembled position. This aspect of the present invention can best be appreciated from the illustrations of FIGS. 24–28.

The interrelationship between the frame 12, the platen 50 and the case 72 will now be discussed in connection with the particularly efficient method of assembling the hand stamp 10 of the present invention. This aspect of the present invention is illustrated in FIGS. 11–27.

Figure 11:
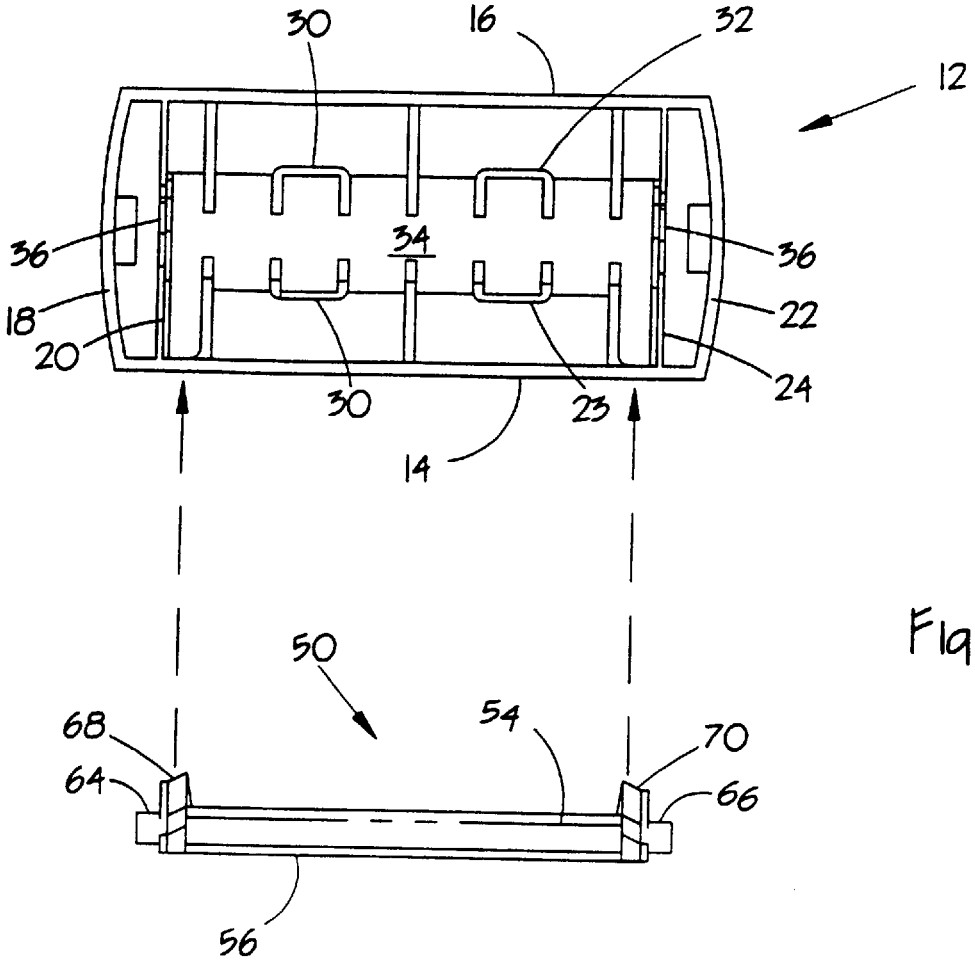
FIG. 11 is a top plan view of the frame in conjunction with a side view of the platen illustrating the relationship between the platen and the frame prior to commencing loading of the platen in accordance with the method of the present invention.

FIG. 11 illustrates the relationship between the platen 50 and the frame 12 prior to loading of the platen within the frame during assembly operations.

Figure 12:
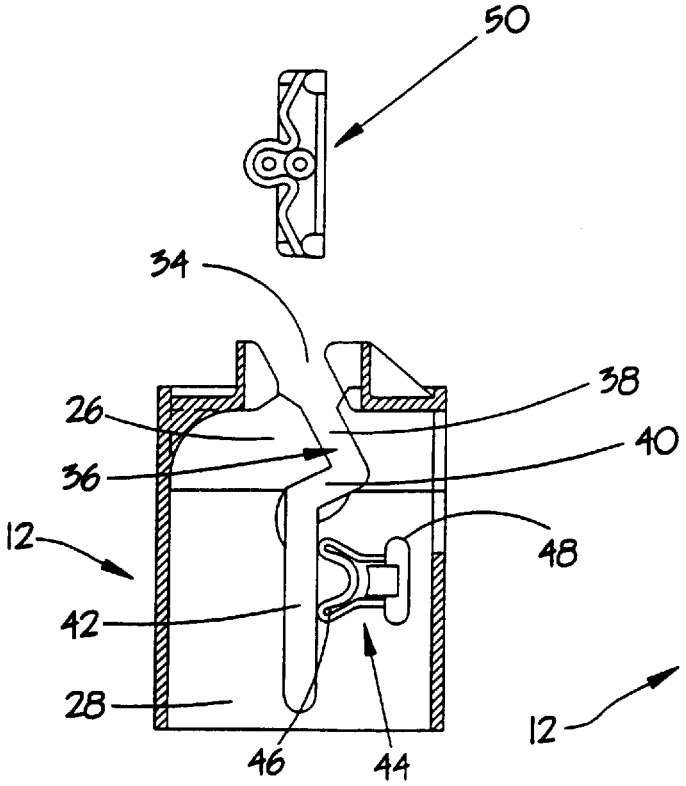
FIG. 12 is a side sectional view of the frame and a side view of the platen illustrating a first step of a method of arranging the platen within the frame of the hand stamp.
Figure 13:
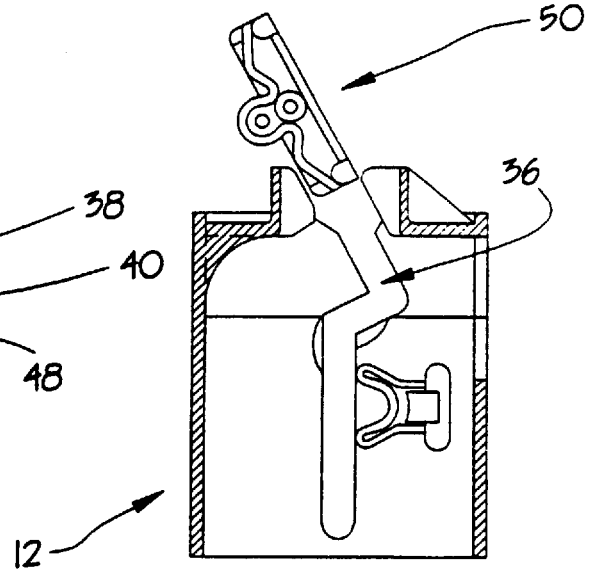
FIG. 13 is a side sectional view of the frame and a side view of the platen illustrating a second step of a method of arranging the platen within the frame of the hand stamp.
Figure 14:
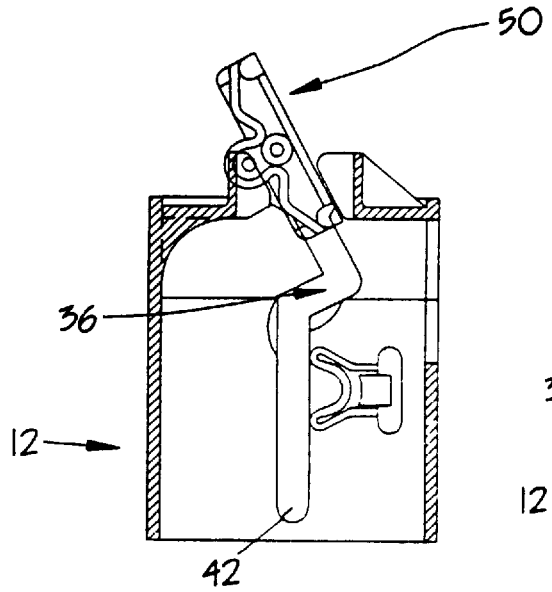
FIG. 14 is a side sectional view of the frame and a side view of the platen illustrating a third step of a method of arranging the platen within the frame of the hand stamp.
Figure 15:
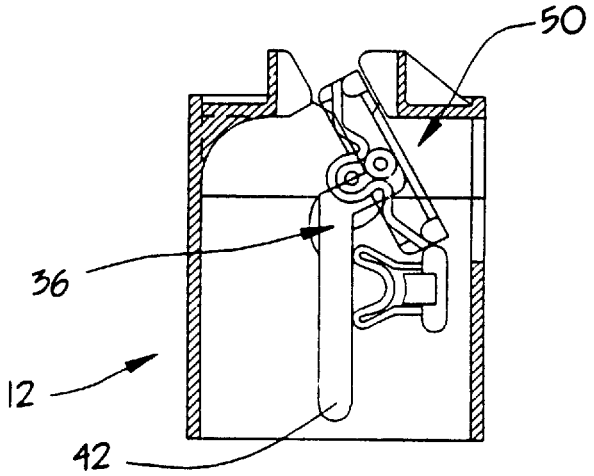
FIG. 15 is a side sectional view of the frame and a side view of the platen illustrating a fourth step of a method of arranging the platen within the frame of the hand stamp.
Figure 16:
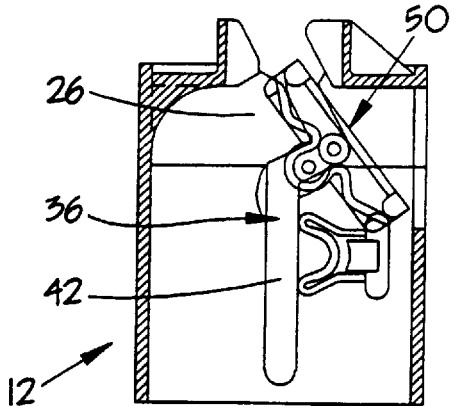
FIG. 16 is a side sectional view of the frame and a side view of the platen illustrating a fifth step of a method of arranging the platen within the frame of the hand stamp.

With particular reference to FIG. 12, the platen 50 should be aligned with the guide slot 34 at the top portion 26 of the frame 12. Since the guide slot 34 is open at the top portion 26 of the frame, the platen can be easily placed within the frame. As shown in FIG. 13, the platen 50 initially enters the top portion 26 of the frame 12 as it is placed within the guide slot 34. In the preferred embodiment of the present invention, the platen 50 enters the guide slot 34 at an angle as it is placed within the top-most portion 38 of the guide slot 36. The platen is then guided downwardly toward the bottom of the frame 12 at the angle dictated by the arrangement of the top portion 38 of the guide slot. As the platen 50 moves through the top portion 38 of the guide slot 34, the left and right projections 64 and 66 are retained within the end portions 36 of the guide slot 34 at the corresponding left and right inner side walls 20 and 24 of the frame 12. Two of the bumper pins 62 then contact the bumpers 48 of the turnover mechanism 44 at the left and right inner side walls 20 and 24 of the frame 12. This contact between the bumper pins 62 and the fixed bumpers 48 starts the process of flipping the platen so that the top surface 54 of the central body 52 begins to turn toward the bottom portion 28 of the frame 12.

Figure 17:
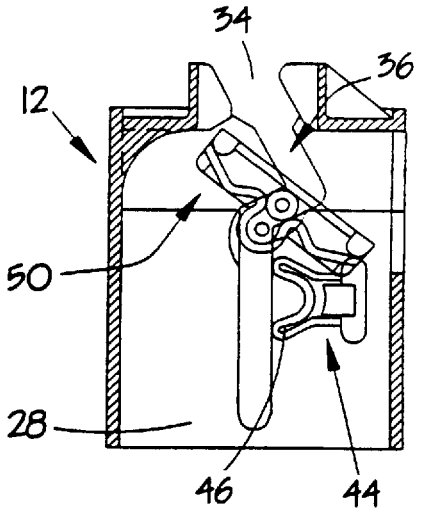
FIG. 17 is a side sectional view of the frame and a side view of the platen illustrating a sixth step of a method of arranging the platen within the frame of the hand stamp.

As the platen 50 bottoms out at the top portion 38 of the guide slot, it begins moving through the second angled portion 40 in an opposite direction to its previous path of travel. The left and right projections 64 and 66 of the platen axle thus continue to follow the path defined by the second angled portion 40 of the guide slot 36 within the left and right inner walls 20 and 24 of the frame 12. At this time, the platen 50 has traveled through the path illustrated in FIGS. 13–16. As shown in FIG. 17, the platen 50 continues to rotate so that the top surface 54 of the central body 52 continues to flip toward the bottom portion 28 of the frame 12. A pair of bumper pins 62 remain in contact with the fixed bumper 48 of the turnover mechanism 44 on the left and right sides of the frame.

Figure 18:
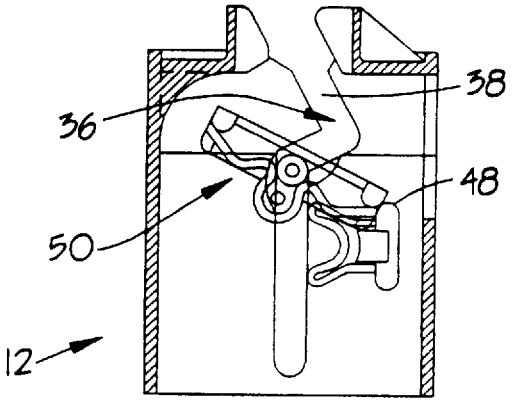
FIG. 18 is a side sectional view of the frame and a side view of the platen illustrating a seventh step of a method of arranging the platen within the frame of the hand stamp.
Figure 19:
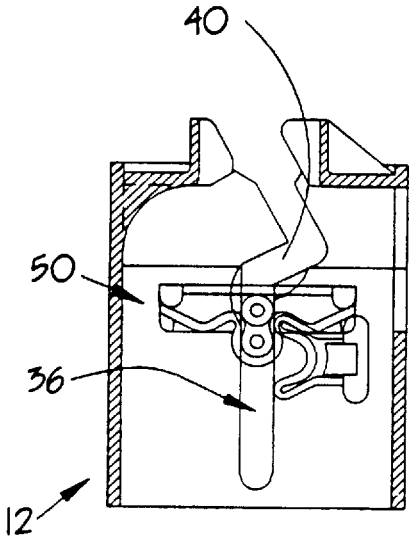
FIG. 19 is a side sectional view of the frame and a side view of the platen illustrating a eighth step of a method of arranging the platen within the frame of the hand stamp.

As the left and right projections 64 and 66 of the platen 50 approach the vertical portion 42 of the guide slots 36 the cam followers 68 and 70 and the corresponding fixed cams 46 of the turnover mechanisms 44 at the left and right sides of the frame begin to come into play as shown in FIGS. 18 and 19.

FIG. 19 illustrates the orientation of the platen 50 as it is entirely flipped over so that the top surface 54 is facing the bottom portion of the frame 28 and the bottom stamp-carrying surface 56 is facing the top portion 26 of the frame. The stamp-carrying surface 56 is adapted to retain an impression creating member thereon. In the embodiment of a self-inking stamp, the impression creating member is typically made of rubber. If a pre-inked stamping member is desired, a microporous marking structure may be mounted on the stamp-carrying surface 56 of the platen 50.

Figure 20:
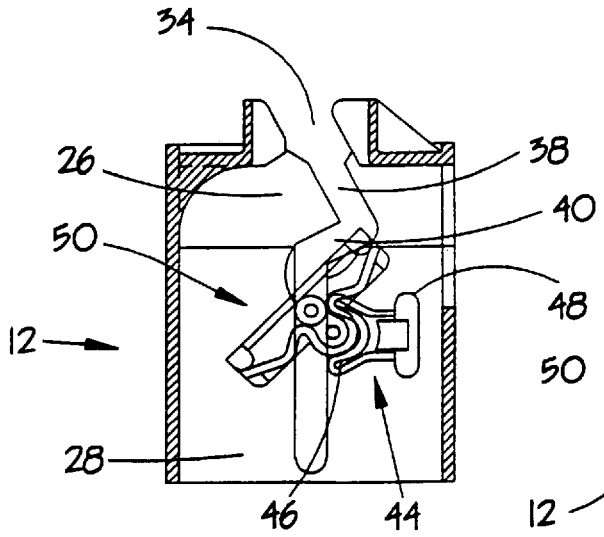
FIG. 20 is a side sectional view of the frame and a side view of the platen illustrating a ninth step of a method of arranging the platen within the frame of the hand stamp.
Figure 21:
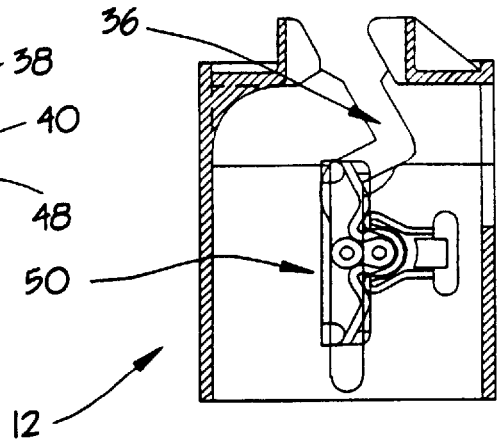
FIG. 21 is a side sectional view of the frame and a side view of the platen illustrating a tenth step of a method of arranging the platen within the frame of the hand stamp.
Figure 22:
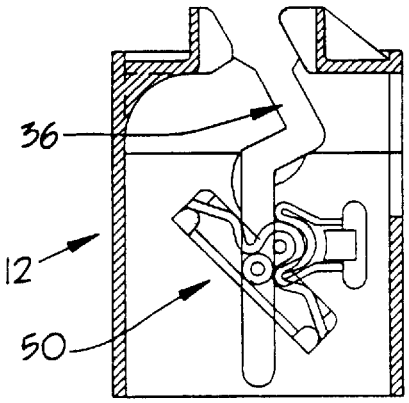
FIG. 22 is a side sectional view of the frame and a side view of the platen illustrating a eleventh step of a method of arranging the platen within the frame of the hand stamp.
Figure 23:
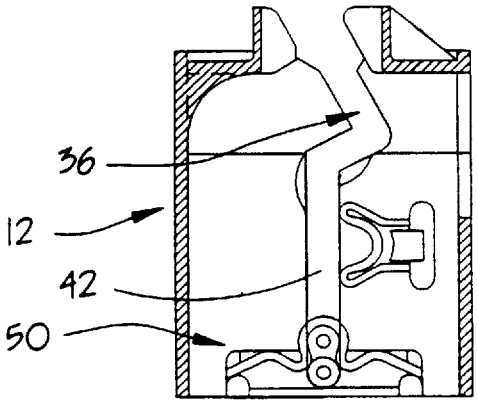
FIG. 23 is a side sectional view of the frame and a side view of the platen illustrating a twelfth step of a method of arranging the platen within the frame of the hand stamp.

As shown in FIG. 20, the platen 50 pivots about a top portion of the fixed cam 46. Thus, each of the cam followers 68 and 70 on the left and right sides of the platen rotates into a corresponding recess of the fixed cams 46 at the left and right inner side walls 20 and 24 of the frame 12. Rotation of the platen 50 continues as shown in FIG. 21 as the platen rotates through a vertical position at which the cam followers 68 and 70 may be entirely within the recess of the corresponding fixed cams 46 at the left and right inner side walls 20 and 24. Gravity continues to urge the platen 50 toward the bottom portion 28 of the frame while the cooperating structure between the left and right cams 46 and the left and right cam followers 68 and 70 continues to force the platen 50 to rotate downwardly. As shown in FIG. 22, the left and right cam followers 68 and 70 begin to slide out of the recess of the corresponding fixed cams 46 while the platen 50 is driven toward the bottom portion 28 of the frame 12 by gravity.

Finally, the platen bottoms out as the bottom stamp-carrying surface 56 falls to the bottom portion 28 of the frame 12. As can be appreciated, the left and right projections 64 and 66 of the platen 50 are retained within the guide slot portions 36 of the left and right inner side walls 20 and 24 of the frame 12 during the entire loading process. Further, it should be appreciated that once the platen 50 is released into the guide slot 34 of the top portion 26 of the frame 12, the platen automatically advances to its bottom loaded position under the force of gravity. The entire process of dropping the platen into the top portion of the frame and rotating the platen until it is arranged in its bottom-most position may take only about a second.

Figure 24:
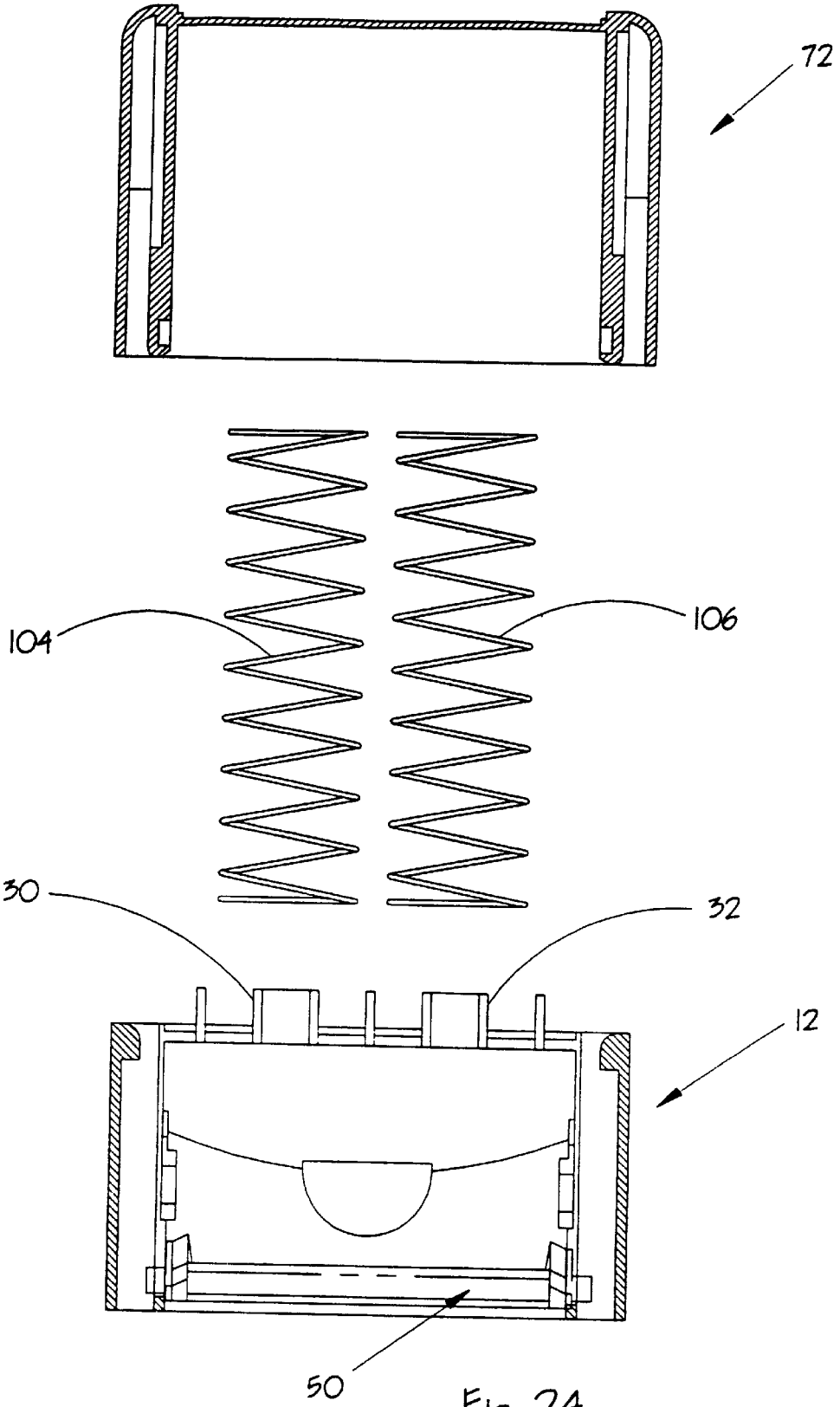
FIG. 24 is a front sectional exploded view of the frame and the case after the platen has been loaded and illustrating the placement of springs into assembled position in accordance with a first step of the method of assembling a case onto the frame and the platen.
Figure 25:
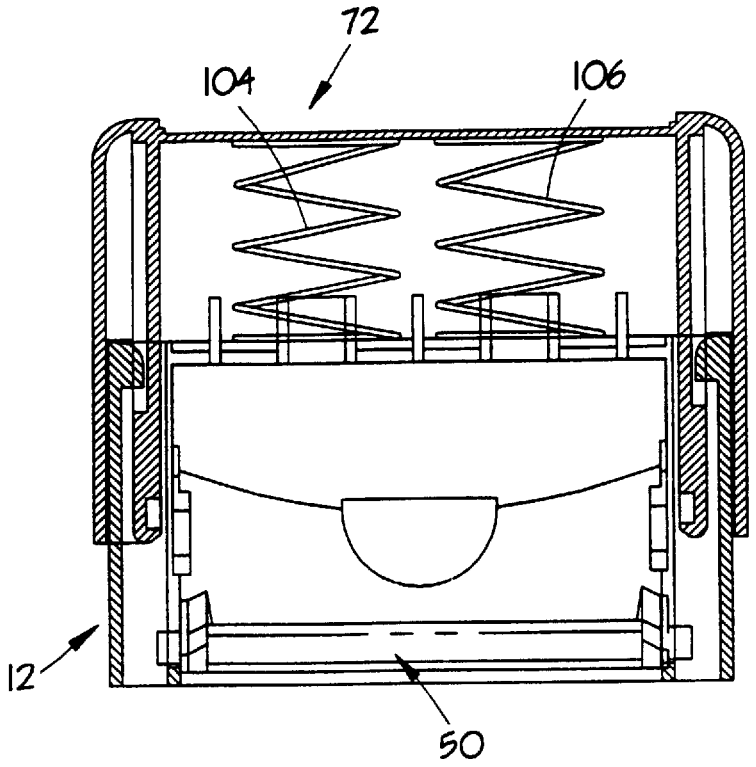
FIG. 25 is a front sectional view of the present hand stamp illustrating compression of the springs during the step of assembling and locking the case onto the frame and the platen.
Figure 26:
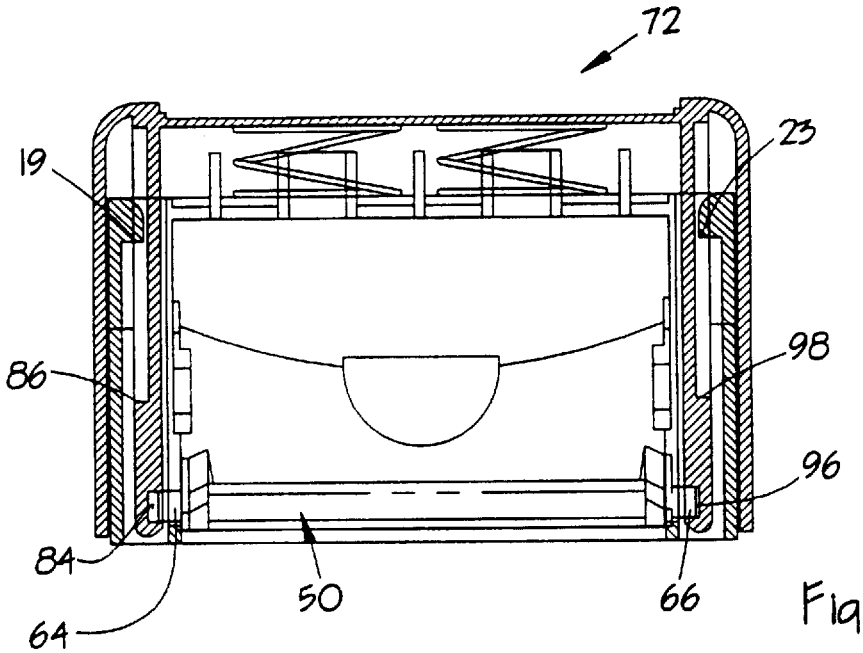
FIG. 26 is a front sectional view of the present hand stamp illustrating the springs in their entirely compressed state upon initial assembly of the case to the platen.

Before attaching the case 72 to the platen 50 and the frame 12, it may be desirable to arrange left and right springs 104 and 106 on the spring retainers 30 and 32. As shown in FIGS. 24–26, the bottom of the springs 104 and 106 are supported by the top portion of the frame 12 and are arranged around the spaced left and right spring retainers 30 and 32. The left and right springs 104 and 106 traverse across the opening defined by the guide slot 34 at the top portion 26 of the frame 12. As illustrated in FIGS. 25 and 26, the left and right springs 104 and 106 are arranged in their relaxed extended state prior to placement of the case 72 in its assembled position.

FIGS. 24–27 also illustrates the final steps in assembling the hand stamp 10. To this end, the case 72 is placed in an aligned position above the frame 12 and the springs 104 and 106 which extend upwardly therefrom. The platen 50 should be arranged in assembled position at the bottom portion 28 of the frame at this time. The case 72 is then advanced downwardly over the springs 104 and 106 and the frame 12. The left and right flexible fingers 82 and 94 of the case 72 are urged inwardly by the left and right locking tab projections 19 and 23 of the frame 12. At this time, the left and right outer walls 78 and 90 of the case 72 should be at least substantially adjacent to the corresponding left and right outer side walls 18 and 22 of the frame 12.

As the case 72 continues to be advanced downwardly toward the bottom portion 28 of the frame 12, the left and right flexible fingers 82 and 94 are pushed below the left and right locking tab projections 64 and 66 of the frame 12. The flexible fingers then extend slightly outwardly toward the left and right outer walls 70 and 90 of the case 72 as the space 100 between the inner and outer walls increases in size.

As shown in FIG. 25, the corresponding ledges 86 and 98 on the left and right flexible fingers 82 and 94 are then arranged below the bottom portion of the left and right locking tab projections 19 and 23 of the corresponding outer side walls 18 and 22 of the frame 12. As can be appreciated from the disclosure in FIG. 25, it is the relationship between the left and right ledges 86 and 98 of the flexible fingers and the left and right locking tab projections 19 and 23 which function as a locking mechanism to assure that the case 72 cannot become disassembled from the frame 12 during normal operation once the components are snapped into assembled position.

In completing the assembly method, the case 72 is then continuously urged toward the bottom portion 28 of the frame 12. This causes the springs 104 and 106 to be compressed between the top portion of the frame 12 and the bottom side of the top portion 102 of the case 72. The left and right flexible fingers 82 and 94 are then pressed over the left and right locking tab projections 19 and 23 of the platen axle until the left and right locking tab projections 19 and 23 snap into assembled position within the corresponding left and right recesses 84 and 96. This step of the present invention can be appreciated with reference to FIG. 26. It should be further appreciated that the case 72 is now assembled to the platen 50 and is mounted over a portion of the frame 12.

Figure 27:
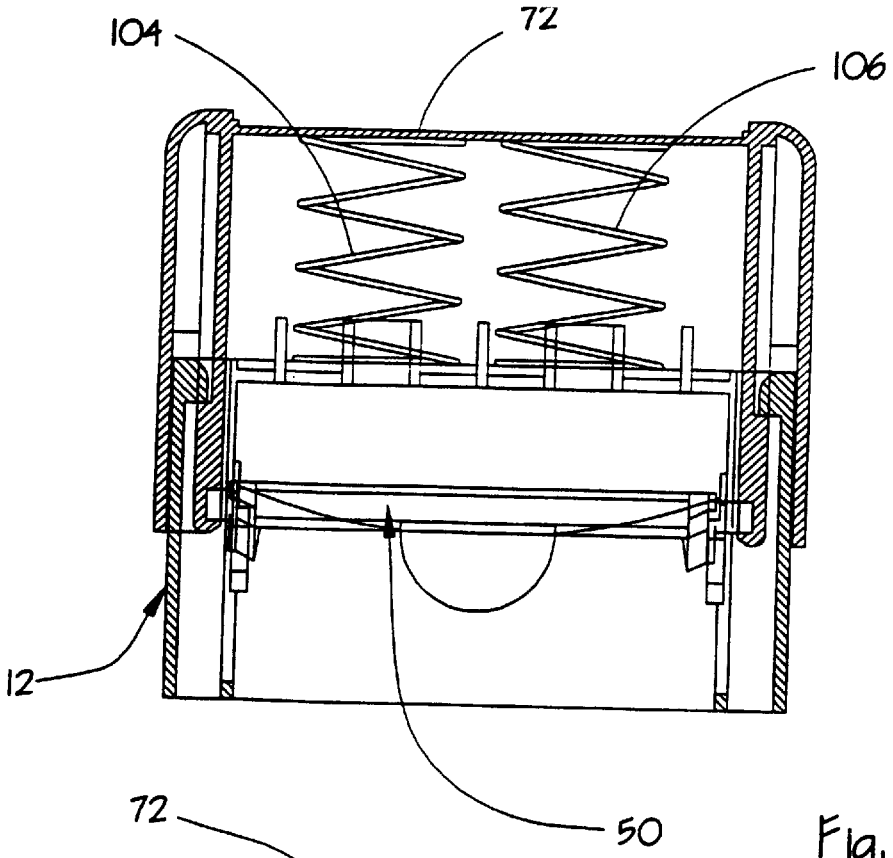
FIG. 27 is a front sectional view of the various components of the present hand stamp illustrating the structural relationship of the components after the hand stamp is entirely assembled and the springs partially extend to their normal static position between the top of the frame and the case.

When downward pressure is removed from the case 72, the inherent compression forces exerted upwardly by the compressed springs 104 and 106 will cause the case 72 to move upwardly to its normally static position. The novel locking feature of the present invention will now come into play as the corresponding left and right ledges 86 and 98 of the flexible fingers will become engaged with the left and right locking tab projections 19 and 23 on the outer side walls 18 and 22 of the frame 12. This aspect of the present invention is shown in FIG. 27.

When it is desired to use the hand stamp 10, all that is required is that downward pressure be applied to the case 72 which serves as an actuating device which causes the platen to slide along the guide slot portions 36 in the left and right walls of the frame 12 as the platen is moved from its non-stamping position to a stamping position. This aspect of the present invention is well known in the self-inking stamp art. In particular, reference is made to M&R Marking Systems'IDEAL line of self-inking stamps and the disclosure in U.S. Pat. Nos. 4,852,489 and 4,432,281, both of which are assigned to M&R Marking Systems.

It should be appreciated that various modifications to the hand stamp disclosed herein and the steps of the method of assembling the present hand stamp can be made in the descriptions set forth herein while remaining within the scope of the present application. Indeed, such modifications are encouraged to be made to the features of the disclosed hand stamp and the steps of the method while remaining within the scope of the claims set forth below.

We claim:

1. A hand stamp comprising:

a platen adapted for movement between a stamping position and a non-stamping position; a unitary frame including a top portion, a bottom portion and at least a pair of opposing side portions, said frame having a passageway arranged at said top portion and extending downwardly through said opposing side portions toward said bottom portion, said passageway being open at said top portion for receiving said platen during assembly operations, said passageway remaining open at said top portion of said frame when said hand stamp is fully assembled; and case connected to said platen and being mounted over a portion of said frame for effecting movement of said platen along said passageway between said stamping position and said non-stamping position.

2. The hand stamp of claim 1 wherein said passageway comprises first and second opposing slots arranged in said opposing side portions of said frame and wherein each of said first and second opposing slots are open at said top portion.

3. The hand stamp of claim 2 wherein said platen comprises a central body having first and second sides and a first projection extending from said first side and a second projection extending from said second side, said first and second projections being arranged in assembled position within corresponding ones of said first and second opposing slots.

4. The hand stamp of claim 3 further comprising a case connected to said first and second projections of said platen, said case being mounted over a portion of said frame for effecting movement of said platen between said non-stamping position and said stamping position upon sliding of said platen along said first and second opposing slots.

5. The hand stamp of claim 2 wherein said first and second opposing slots are closed at said bottom portion.

6. The hand stamp of claim 1 further comprising a case connected to said platen and mounted over a portion of said frame for effecting movement of said platen between said non-stamping position and said stamping position upon sliding of said platen along said passageway within said pair of opposing side portions of said frame.

7. A hand stamp comprising:

a platen including a central body having first and second sides and a first projection extending from said first side and a second projection extending from said second side, said first and second projections having a common axis, said body including a stamp-carrying surface; a frame including a top portion, a bottom portion and a first side having a first slot therein and a second side opposing said first side and having a second slot therein, said first and second projections of said platen being arranged for slidable movement within corresponding ones of said first and second slots when said hand stamp is in assembled position, said first and second slots being open at said top portion of said frame for receiving said corresponding first and second projections during assembly operations, said first and second slots remaining open at said top portion of said frame when said hand stamp is fully assembled, said platen and said frame including cooperating turnover means for facilitating movement of said stamp-carrying surface between a non-stamping position and a stamping position; and a case connected to said first and second projections of said platen, said case mounted over a portion of said frame for effecting said slidable movement of said platen between said non-stamping position and said stamping position upon sliding of said first and second projections of said platen along said first and second slots of said frame.

8. The hand stamp of claim 7 wherein said first and second slots are closed at said bottom portion of said frame.

9. The hand stamp of claim 7 wherein said platen includes an axle having a first end and a second end, said first and second projections including said first and second ends of said axle.

10. The hand stamp of claim 9 wherein said axle is integral with said central body of said platen.

11. The hand stamp of claim 7 wherein each of said first and second sides of said frame has an outer wall and an inner wall; said case including first and second sides arranged between said outer wall and said inner wall of corresponding first and second sides of said frame.

12. The hand stamp of claim 7 wherein said turnover means on said frame comprises at least one fixed cam arranged on at least one of said first and second sides.

13. The hand stamp of claim 12 wherein said turnover means of said platen comprises at least one cam follower arranged to cooperate with said at least one fixed cam of said frame so that said platen can be flipped between said non-stamping position and said stamping position.

14. A method of assembling a hand stamp, said method comprising the steps of:

providing a unitary frame having a top portion and a bottom portion and first and second side walls with first and second opposing slots arranged within said first and second side walls respectively, said opposing slots being open at said top portion and extending downwardly toward said bottom portion; and arranging a platen having opposing first and second projections thereon within said frame by placing said first and second projections of said platen through corresponding ones of said first and second opposing slots at said top portion, placing at least one spring on top of said frame immediately after placement of said platen within said frame; and then arranging a case over said at least one spring and the top portion of said frame, and connecting said case to said platen.

15. The method of claim 14 wherein said platen comprises a central body having first and second sides and a first projection extending from said first side and a second projection extending from said second side, said central body including a stamp-carrying surface, said platen and said frame including cooperating turnover means for facilitating movement of said stamp-carrying surface between a non-stamping position and a stamping position, said step of arranging said platen in said frame comprising the step of placing said first and second projections within said passageway at said top portion of said frame, and releasing said platen so that said cooperating turnover means causes said platen to flip within said frame.

16. The method of claim 15 further comprising the steps of arranging a case over a portion of said frame and connecting said case to said first and second projections of said platen.

17. The method of claim 14 further comprising the step of releasing said platen so that said cooperating turnover means automatically causes said platen to flip over within said frame.

18. The method of claim 17 further comprising the steps of arranging a case over a portion of said frame and connecting said case to said first and second projections of said platen.

19. The method of claim 18 wherein said first and second opposing slots are closed at said bottom portion of said frame, said step of connecting said case to said first and second projections being performed when said platen is arranged at said bottom portion of said frame.

20. A hand stamp comprising:

a frame including a pair of opposing side walls and a locking tab extending from at least one of said opposing side walls; a platen operatively arranged within said frame for movement between a non-stamping position and a stamping position; and a case connected to said platen and having a double-walled section arranged over said opposing side walls of said frame, said double-walled section including at least one ledge adapted to contact said at least one locking tab of said frame to prevent said frame from becoming separated from said case after said case is arranged in assembled position over said frame.

21. The hand stamp of claim 20 wherein said platen includes a central body having first and second sides and a first projection extending from said first side and a second projection extending from said second side, a portion of said double-walled section of said case including first and second flexible fingers each having a recess therein, said recesses being sized and shaped to receive corresponding ones of said first and second projections of said platen when said case is connected to said platen in assembled position.

22. The hand stamp of claim 21 wherein said double-walled section includes an inner wall and an outer wall, said first and second flexible fingers comprising at least a portion of said inner wall, said at least one ledge being part of said inner wall.

* * * * *

UNITED STATES PATENT AND TRADEMARK OFFICE

CERTIFICATE OF CORRECTION

PATENT NO. : 5,768,992

DATED : June 23, 1998

INVENTOR(S) : Daw et al.

It is certified that error appears in the above-identified patent and that said Letters Patent is hereby corrected as shown below:

Column 1, line 4, "FIELD THE INVENTION" should read --FIELD OF THE INVENTION--.

Column 10, line 61, "and case" should read --and a case--.

Signed and Sealed this

Seventeenth Day of November, 1998

Bruce Lehman

*Attest:*

BRUCE LEHMAN

*Attesting Officer*

*Commissioner of Patents and Trademarks*